US006476334B1

(12) United States Patent
Wu

(10) Patent No.: US 6,476,334 B1
(45) Date of Patent: Nov. 5, 2002

(54) SWITCH BOX STRUCTURE OF A CEILING FAN

(76) Inventor: Chung-Ching Wu, No. 164-4, Alley 9, Lane 287, Section 3, Chung Shan Road, Tan Zi Hsiang, Taichung Hsien (TW)

( * ) Notice: Subject to any disclaimer, the term of this patent is extended or adjusted under 35 U.S.C. 154(b) by 4 days.

(21) Appl. No.: 09/850,088

(22) Filed: May 8, 2001

(51) Int. Cl.[7] ..... H01H 3/00

(52) U.S. Cl. ..... 200/18; 200/9; 200/11 G; 200/6 BB

(58) Field of Search ..... 200/9, 14, 11 G, 200/18, 11 K, 6 BB, 56 G

(56) References Cited

U.S. PATENT DOCUMENTS 5,548,104 A * 8/1996 Ko ..... 200/14

5,609,244 A * 3/1997 Reiter ..... 200/43.11

* cited by examiner

*Primary Examiner*—Michael Friedhofer
*Assistant Examiner*—Lisa N Klaus
(74) *Attorney, Agent, or Firm*—Rosenberg, Klein & Lee

(57) ABSTRACT

The switches of a switch box structure ceiling fan are separated from the ceiling fan, and are placed in a housing which may be mounted at a position that the user can reach, thereby facilitating the user operate the switches which include a lamp source switch, a direction control switch, and a fan switch. In addition, all of the elements of the control switches of the ceiling fan may be placed in the switch box structure to form a module, thereby facilitating assembling and dismantling the control switches of the ceiling fan.

11 Claims, 5 Drawing Sheets

SWITCH BOX STRUCTURE OF A CEILING FAN

BACKGROUND OF THE INVENTION

1. Field of the Invention

The present invention relates to a switch box structure of a ceiling fan.

2. Description of the Related Art

A conventional ceiling fan comprises a control box located under the ceiling fan, a switch mounted in the control box, a decorative lamp hung under the control box, and two pull bar type chains connected to the control box. The chains may be pulled for adjusting and changing the rotational speed of the ceiling fan and the light intensity of the decorative lamp respectively.

However, the user cannot directly control and operate the switch of the ceiling fan, and has to exert a larger force to operate the chains for adjusting the rotational speed of the ceiling fan and the light intensity of the decorative lamp respectively, thereby causing inconvenience to the user and consuming the user's energy. In addition, friction is produced between the parts in the control box and the chain during movement of the chain, so that the parts of the control box are easily worn out during long-term utilization. Further, one chain is used to control the rotational speed of the ceiling fan, and the other chain is used to control the light intensity of the decorative lamp, so that the two chains are separated from each other. Thus, the user cannot control the two chains simultaneously, thereby causing inconvenience to the user.

SUMMARY OF THE INVENTION

The primary objective of the present invention is to provide a switch box structure of a ceiling fan, wherein the switches of the ceiling fan are separated from the ceiling fan, and are placed in a housing which may be mounted at a position that the user can reach, thereby facilitating the user operate the switches which include a lamp source switch, a direction control switch, and a fan switch. In addition, all of the elements of the control switches of the ceiling fan may be placed in the switch box structure to form a module, thereby facilitating assembling and dismantling the control switches of the ceiling fan.

In accordance with the present invention, there is provided a switch box structure of a ceiling fan, comprising:

- a housing including:
  - a top cover having a panel defining a lamp source switch hole, a direction control switch slot, and a fan switch hole, the top cover having a top wall defining a receptacle slot, the top cover having a bottom wall defining a ventilating portion; and
  - a base secured on the top cover, and defining a wire collection hole;
  - a receptacle received in the receptacle slot; and
  - a connecting wire control device mounted in the housing and including:
    - a lamp source switch received in the lamp source switch hole and protruding outward therefrom;
    - a direction control switch received in the direction control switch slot and protruding outward therefrom; and
    - a fan switch received in the fan switch hole and protruding outward therefrom, the fan switch including:

- a lower casing;
- an upper casing secured on the lower casing;
- a plurality of power connection seats secured in the lower casing;
- a plurality of conducting members each mounted in a respective one of the power connection seats;
- a rotation shaft rotatably mounted between the upper casing and the lower casing; and
- a speed control contact member integrally formed on the rotation shaft to rotate therewith, and including a plurality of contact legs each in contact with some respective conducting members during rotation of the rotation shaft.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
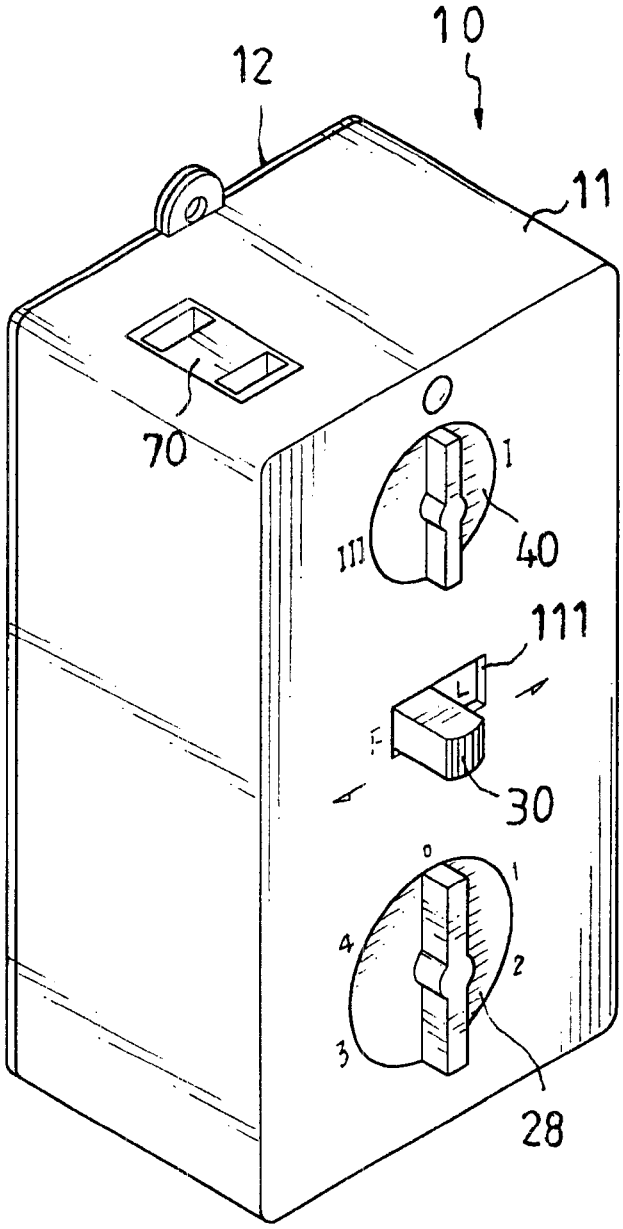
FIG. 1 is a perspective view of a switch box structure of a ceiling fan in accordance with the present invention.
Figure 2:
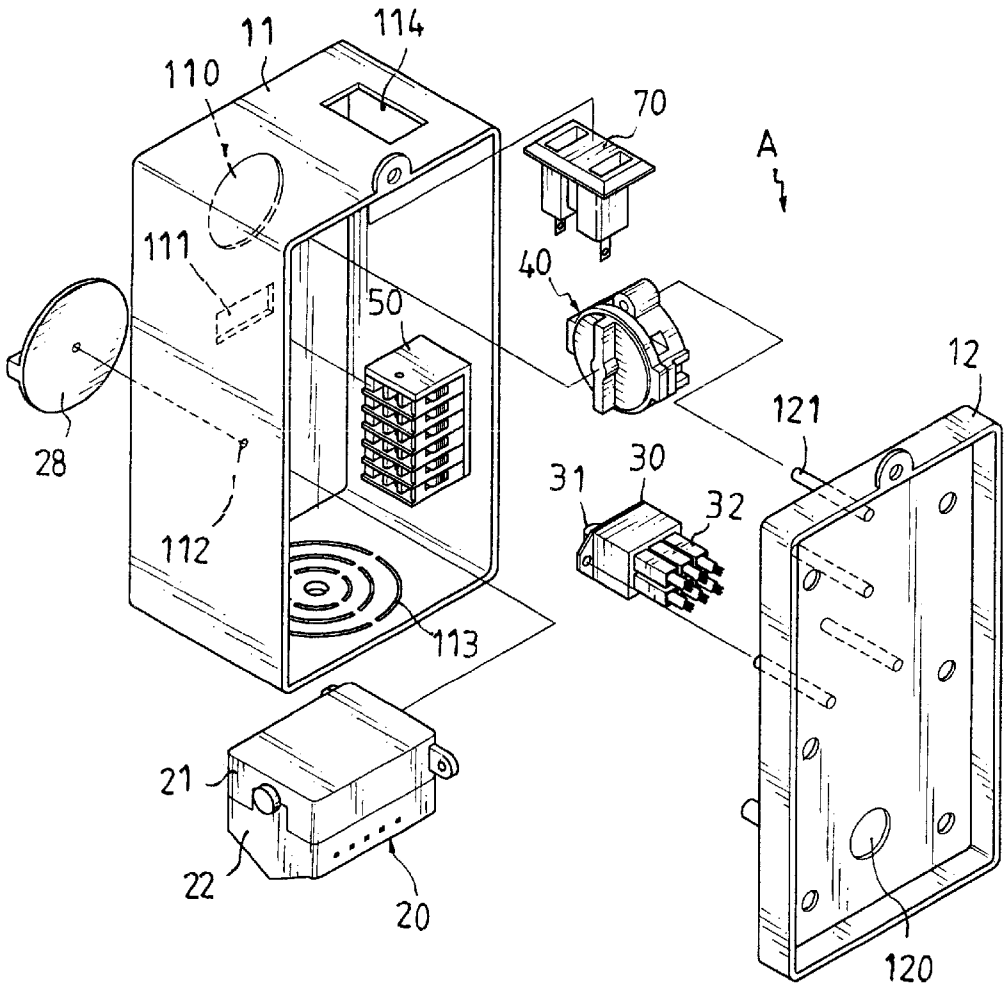
FIG. 2 is an exploded perspective view of the switch box structure of a ceiling fan as shown in FIG. 1.
Figure 3:
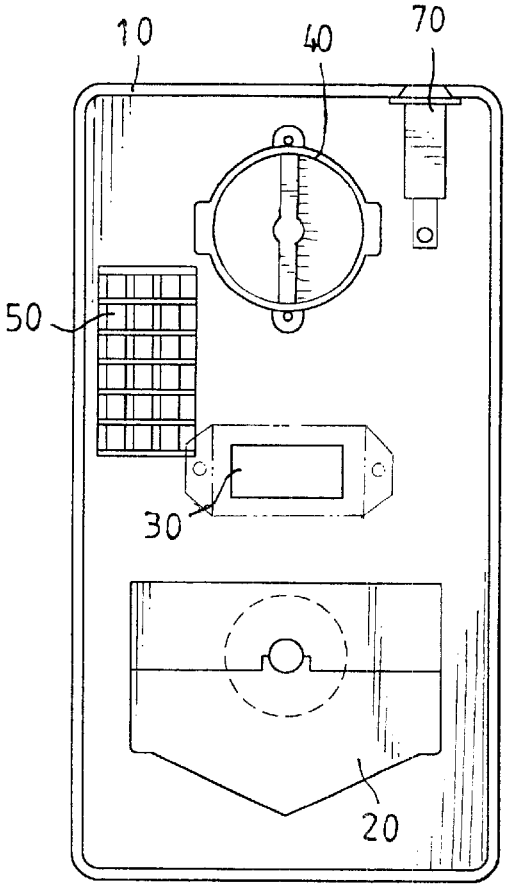
FIG. 3 is a cut-away rear plan view of the switch box structure of a ceiling fan as shown in FIG. 1.
Figure 4:
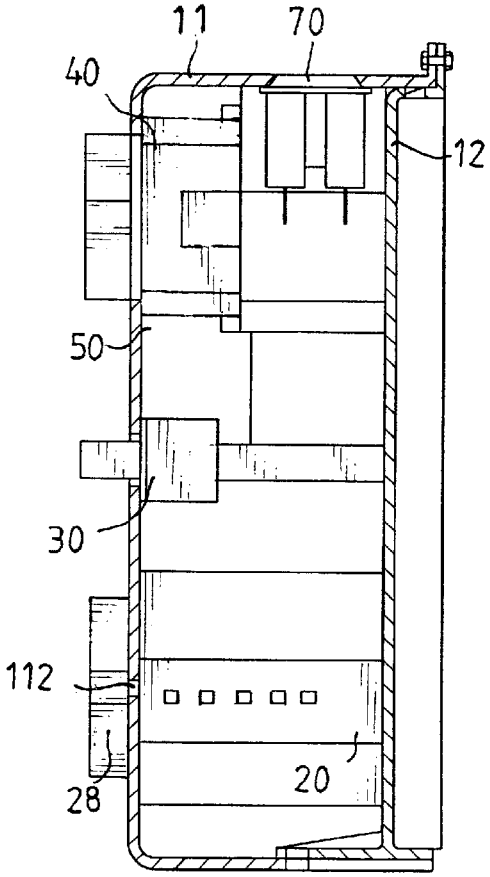
FIG. 4 is a side plan cross-sectional view of the switch box structure of a ceiling fan as shown in FIG. 1.

Referring to the drawings and initially to FIGS. 1–4, a switch box structure of a ceiling fan in accordance with the present invention comprises a housing 10, and a connecting wire control device "A" mounted in the housing 10.

The housing 10 includes a top cover 11, and a base 12. The top cover 11 has a panel in turn defining a lamp source switch hole 110, a direction control switch slot 111 under the lamp source switch hole 110, and a fan switch hole 112 under the direction control switch slot 111. The top cover 11 has a top wall defining a receptacle slot 114 for receiving a receptacle 70, and a bottom wall defining a ventilating portion 113 for providing the ventilating and heat dissipation effect. The base 12 is secured on the top cover 11, and defines a wire collection hole 120 for allowing passage of electric wires (not shown). The base 12 is provided with a plurality of fixing columns 121 for supporting the connecting wire control device "A", thereby facilitating fitting, assembly, and maintenance.

The connecting wire control device "A" includes a lamp source switch 40, a direction control switch 30, a fan switch 20, a wire connection body 50, a capacitor (not shown), and a receptacle 70.

The lamp source switch 40 is received in the lamp source switch hole 110 and protrudes outward therefrom. The lamp source switch 40 is fixed by the fixing columns 121.

The direction control switch 30 is fixed by the fixing columns 121, and has a first side provided with a switch button 31 received in the direction control switch slot 111 and protruded outward therefrom, and a second side provided with a plurality of wire connection portions 32 which are arranged serially, thereby facilitating assembly. Thus, the direction control switch 30 can be used to control the rotation direction of the ceiling fan.

The fan switch 20 passes through the fan switch hole 112 and protrudes outward therefrom. The fan switch 20 is fixed by the fixing columns 121.

Figure 5:
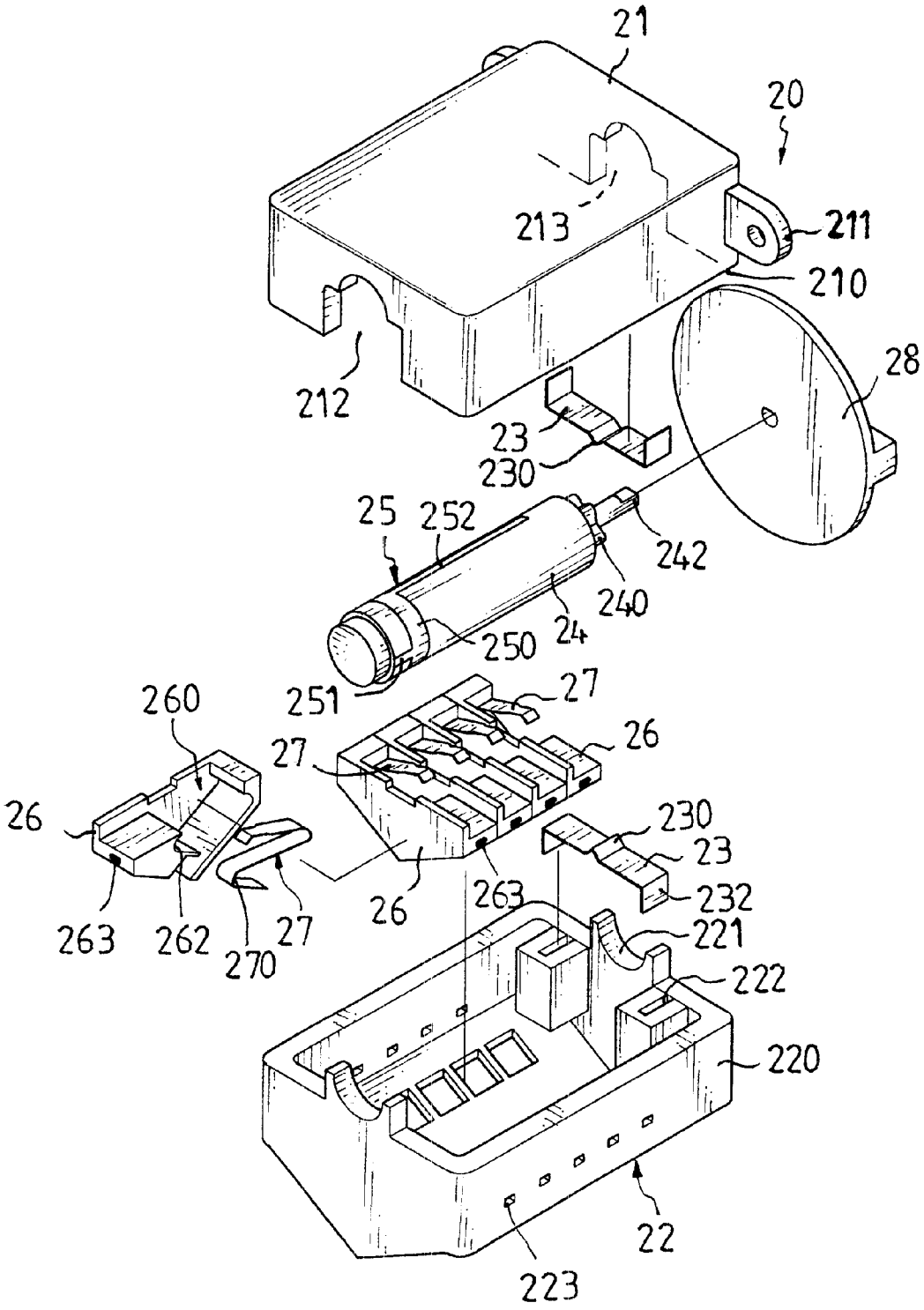
FIG. 5 is an exploded perspective view of a fan switch of the switch box structure of a ceiling fan in accordance with the present invention.
Figure 6:
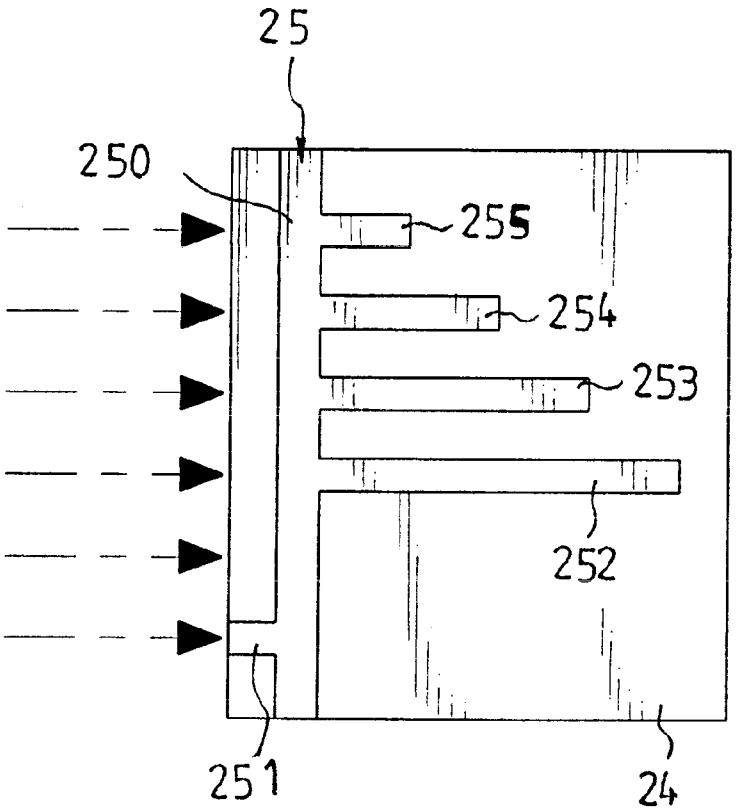
FIG. 6 is a top plan expansion schematic view of a speed control contact member of the fan switch of the switch box structure of a ceiling fan as shown in FIG. 5.

Referring to FIGS. 5 and 6 with reference to FIGS. 1–4, the fan switch 20 includes a lower casing 22, an upper casing 21 secured on the lower casing 22 by a high frequency wave process, a plurality of power connection seats 26 secured in the lower casing 22, a plurality of conducting members 27 each mounted in a respective one of the power connection seats 26, a rotation shaft 24 rotatably mounted between the upper casing 21 and the lower casing 22, and a speed control contact member 25 integrally formed on the rotation shaft 24 to rotate therewith. The speed control contact member 25 includes a plurality of contact legs 251, 252, 253, 254, and 255 each in contact with some respective conducting members 27 during rotation of the rotation shaft 24.

The upper casing 21 of the fan switch 20 has a peripheral wall 210 formed with a plurality of fixing ears 211, for passage of bolts (not shown) so that the upper casing 21 may be secured to the top cover 11. The upper casing 21 of the fan switch 20 has two sides each defining a receiving recess 212 for receiving the rotation shaft 24.

The lower casing 22 of the fan switch 20 has two sides each defining a receiving recess 221 for receiving the rotation shaft 24. The lower casing 22 of the fan switch 20 has a peripheral wall 220 defining a plurality of locking holes 223, and each of the power connection seats 26 is provided with a locking wedge 263 locked in a respective one of the locking holes 223, such that the power connection seats 26 can be directly locked in the lower casing 22 elastically.

The rotation shaft 24 has a distal end formed with a plurality of ratchet teeth 240 arranged in a radiating manner. The fan switch 20 includes two elastic locking members 23 mounted between the upper casing 21, the rotation shaft 24, and the lower casing 22. Each locking member 23 is formed with a V-shaped catch 230 detachably engaged with either one of the ratchet teeth 240, for providing a ratchet effect to the rotation shaft 24.

Each of the two elastic locking members 23 has two legs 232. The lower casing 22 defines two positioning sockets 222 for receiving the two legs 232 of one elastic locking member 23, and the upper casing 21 defines two positioning sockets 213 for receiving the two legs 232 of the other elastic locking member 23.

The distal end of the rotation shaft 24 is formed with an axle 242 protruding outward from the fan switch hole 112, and the fan switch 20 further includes a switch control disk 28 rested on the panel of the top cover 11 and secured on the axle 242 of the rotation shaft 24 for rotating the rotation shaft 24.

Each of the power connection seats 26 defines a receiving chamber 260 for receiving a respective conducting member 27. The receiving chamber 260 of each of the power connection seats 26 is formed with a notch 262, and each of the conducting members 27 is formed with a V-shaped positioning portion 270 secured in the notch 262 of a respective power connection seat 26.

Each of the conducting members 27 has an upper end that may be in contact with the speed control contact member 25 on the rotation shaft 24, and a lower end that may be in contact with a conducting wire (not shown) which is passed through the notch 262 of the receiving chamber 260.

As shown in FIG. 6, the speed control contact member 25 includes a main contact region 250 connected to each of the plurality of contact legs 251, 252, 253, 254, and 255.

In operation, when the switch control disk 28 is rotated, the axle 242 of the rotation shaft 24 is also rotated so that the rotation shaft 24 can be rotated to a first position where the first contact leg 251 of the speed control contact member 25 is in contact with one of the conducting members 27, then to a second position where the second contact leg 252 of the speed control contact member 25 is in contact with four of the conducting members 27, then to a third position where the third contact leg 253 of the speed control contact member 25 is in contact with three of the conducting members 27, then to a fourth position where the fourth contact leg 254 of the speed control contact member 25 is in contact with two of the conducting members 27, and finally to a fifth position where the fifth contact leg 255 of the speed control contact member 25 is in contact with one of the conducting members 27. In such a manner, the rotation speed of the rotation shaft 24 can be changed by rotating the switch control disk 28.

Accordingly, the switch box structure of a ceiling fan in accordance with the present invention has the following advantages.

1. The connecting wire control device "A" is fitted in the housing 10, so that the switch box structure can be assembled and dismantled easily and quickly, thereby facilitating fitting, assembly, and maintenance of the switch box structure.

2. The connecting wire control device "A" has the optimal manner of wire connection and the optimal manner of allocation, so that all of the parts of the control switches of the ceiling fan, such as the lamp source switch 40, the direction control switch 30, and the fan switch 20, are integrated into a module that is mounted in the housing 10 previously. Thus, the electric wires can be connected to the connecting wire control device "A" contained in the housing 10 easily and quickly, thereby greatly facilitating the operator assembling and dismantling the switch box structure of the ceiling fan.

3. The switch box structure may be mounted on the wall and located at a position that the user can reach easily, thereby facilitating the user operate the switches, such as the lamp source switch 40, the direction control switch 30, and the fan switch 20.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A switch box structure of a ceiling fan, comprising:

a housing (10) including:

a top cover (11) having a panel defining a lamp source switch hole (110), a direction control switch slot (111), and a fan switch hole (112), said top cover (11) having a top wall defining a receptacle slot (114), said top cover (11) having a bottom wall defining a ventilating portion (113); and a base (12) secured on said top cover (11), and defining a wire collection hole (120);

a receptacle (70) received in said receptacle slot (114); and a connecting wire control device (A) mounted in said housing (10) and including:

a lamp source switch (40) received in said lamp source switch hole (110) and protruding outward therefrom;

a direction control switch (30) received in said direction control switch slot (111) and protruding outward therefrom; and a fan switch (20) received in said fan switch hole (112) and protruding outward therefrom, said fan switch (20) including:

a lower casing (22);

an upper casing (21) secured on said lower casing (22);

a plurality of power connection seats (26) secured in said lower casing (22);

a plurality of conducting members (27) each mounted in a respective one of said power connection seats (26);

a rotation shaft (24) rotatably mounted between said upper casing (21) and said lower casing (22); and a speed control contact member (25) integrally formed on said rotation shaft (24) to rotate therewith, and including a plurality of contact legs each in contact with some respective conducting members (27) during rotation of said rotation shaft (24).

2. The switch box structure of a ceiling fan as claimed in claim 1, wherein said upper casing (21) of said fan switch (20) has a peripheral wall formed with a plurality of fixing ears (211).

3. The switch box structure of a ceiling fan as claimed in claim 1, wherein said upper casing (21) of said fan switch (20) has two sides each defining a receiving recess (212) for receiving said rotation shaft (24).

4. The switch box structure of a ceiling fan as claimed in claim 1, wherein said lower casing (22) of said fan switch (20) has two sides each defining a receiving recess (221) for receiving said rotation shaft (24).

5. The switch box structure of a ceiling fan as claimed in claim 1, wherein said lower casing (22) of said fan switch (20) has a peripheral wall defining a plurality of locking holes (223), and each of said power connection seats (26) is provided with a locking wedge (263) locked in a respective one of said locking holes (223), such that said power connection seats (26) can be directly locked in said lower casing (22) elastically.

6. The switch box structure of a ceiling fan as claimed in claim 1, wherein said rotation shaft (24) has one end formed with a plurality of ratchet teeth (240) arranged in a radiating manner, and said fan switch (20) further includes two elastic locking members (23) mounted between said upper casing (21), said rotation shaft (24), and said lower casing (22), each locking member (23) formed with a catch (230) detachably engaged with either one of said ratchet teeth (240).

7. The switch box structure of a ceiling fan as claimed in claim 6, wherein said one end of said rotation shaft (24) is formed with an axle (242) protruding outward from said fan switch hole (112), and said fan switch (20) further includes a switch control disk (28) rested on said panel of said top cover (11) and secured on said axle (242) of said rotation shaft (24) for rotating said rotation shaft (24).

8. The switch box structure of a ceiling fan as claimed in claim 6, wherein each of said two elastic locking members (23) has two legs (232), said lower casing (22) defines two positioning sockets (222) for receiving said two legs (232) of one elastic locking member (23), and said upper casing (21) defines two positioning sockets (213) for receiving said two legs (232) of the other elastic locking member (23).

9. The switch box structure of a ceiling fan as claimed in claim 1, wherein each of said power connection seats (26) defines a receiving chamber (260) for receiving a respective conducting member (27).

10. The switch box structure of a ceiling fan as claimed in claim 9, wherein said receiving chamber (260) of each of said power connection seats (26) is formed with a notch (262), and each of said conducting members (27) is formed with a V-shaped positioning portion (270) secured in said notch (262) of a respective power connection seat (26).

11. The switch box structure of a ceiling fan as claimed in claim 1, wherein said speed control contact member (25) includes a main contact region (250) connected to each of said plurality of contact legs.

* * * * *